United States Patent [19]

Carter

[11] Patent Number: 4,486,907

[45] Date of Patent: Dec. 11, 1984

[54] SELF-FLUSHING ROTATABLE POP-UP WATER DELIVERY HEAD FOR POOL CLEANING SYSTEMS

[76] Inventor: Heard L. Carter, 8412 E. Malcomb, Scottsdale, Ariz. 85253

[21] Appl. No.: 531,062

[22] Filed: Sep. 12, 1983

[51] Int. Cl.[3] ..... E04H 3/20

[52] U.S. Cl. ..... 4/490; 4/492; 134/167 R; 239/206; 239/246; 239/262

[58] Field of Search ..... 4/490, 492; 15/1.7; 134/167 R, 168 R; 239/206, 246, 262

[56] References Cited

U.S. PATENT DOCUMENTS

| | | | |
|---|---|---|---|
| 3,449,772 | 6/1969 | Werner | 134/167 R |
| 3,521,304 | 7/1970 | Ghiz | 15/1.7 |
| 3,616,468 | 11/1971 | Takacs . | |
| 3,675,252 | 7/1972 | Ghiz . | |
| 3,771,723 | 11/1973 | Ray | 239/206 |
| 4,188,673 | 2/1980 | Carter . | |
| 4,271,541 | 6/1981 | Mathews | 4/490 |
| 4,322,860 | 4/1982 | Gould | 4/490 |
| 4,347,979 | 9/1982 | Mathews | 4/490 |
| 4,371,994 | 2/1983 | Mathews | 4/492 |
| 4,391,005 | 7/1983 | Goettl | 4/492 |
| 4,406,026 | 9/1983 | Steimle | 4/492 |

FOREIGN PATENT DOCUMENTS

| | | | |
|---|---|---|---|
| 24538 | 12/1960 | Fed. Rep. of Germany | 239/206 |

*Primary Examiner*—Stephen Marcus
*Assistant Examiner*—L. J. Sholl
*Attorney, Agent, or Firm*—Warren F. B. Lindsley

[57] ABSTRACT

An improved swimming pool mounted rotatable head for a water jet pool cleaning system adapted to rotate in a non-uniform sequential manner during a pool cleaning operation to maintain deleterious matter in suspension so that it may be removed by the main drain or skimmer inlets of the water circulation system. A means is incorporated for flushing sand and other debris from around the moving head and from the immediate pool surface area surrounding the head.

9 Claims, 5 Drawing Figures

SELF-FLUSHING ROTATABLE POP-UP WATER DELIVERY HEAD FOR POOL CLEANING SYSTEMS

BACKGROUND OF THE INVENTION

This invention relates to a swimming pool cleaning system and more particularly to a swimming pool cleaning system wherein a plurality of rotary jet nozzles are disposed adjacent inner surfaces of the pool to wash the inner surfaces, and also to maintain deleterious matter in suspension in the water so that it may be carried outward through the main drain or the skimmer inlets of the pool water circulating apparatus.

Many devices and methods have been used for cleaning deleterious matter from the interior of a swimming pool. Some of them include manually operated vacuum pickups, others include snake-like water jet tubes of flexible character which operate in a generally sinusoidal movement, and rub the bottom of the pool while moving around and creating jet streams along the inner surfaces of the pool.

Other prior art devices have included nozzles adjacent the inner surfaces of the pool stucture, and these nozzles have been unidirectional or monodirectional, and have been partially successful; however, most prior art pool cleaning systems have required a substantial amount of attention, labor, and/or maintenance.

DESCRIPTION OF THE PRIOR ART

U.S. Pat. No. 3,675,252 discloses a system for cleaning the inner surface of a swimming pool employing a rotary jet delivery head adapted to constantly rotate 360 degrees.

U.S. Pat. No. 3,616,468 discloses a radial tube which is rotatable about a vertical axis at the pool center adjacent the pool bottom to prevent debris from collecting on the pool bottom.

U.S. Pat. No. 3,449,772 discloses an automatically cycling swimming pool cleaning system wherein automatically extending and retracting water driven jets are rotated slowly about two revolutions per minute in discrete increments through the intermittent impact imparted to the nozzle by a circulating ball carried by a stream of water in route to the nozzle of the cleaning head.

U.S. Pat. No. 4,188,673, issued to the inventor of the present invention, discloses a swimming pool mounted rotatable head for a water jet pool cleaning system adapted to rotate in a non-uniform sequential manner during a pool cleaning operation to maintain deleterious matter in suspension in the water so that it may be removed by the main drain or skimmer inlets of the pool water circulation system.

While the device of U.S. Pat. No. 4,188,673 provided substantial improvements over other prior art devices, there are two problems or deficiencies associated with the operation of the device that are suggestive of further improvement. The first problem is that the single water jet which is offset from the center of the head to serve as a means for rotating the head is not as effective as desired in this capacity when the head is mounted on an inclined pool surface. A second undesirable operational characteristic is that debris tends to collect immediately adjacent the head and is drawn into the recesses surrounding the head as the head rises from its cavity in the surface of the pool. The ingested debris then interferes with the smooth operation of the device.

SUMMARY OF THE INVENTION

In accordance with the invention claimed, an improved rotary water dispensing pop-up head for a water delivery and pool cleaning system is provided which rotates in a non-uniform sequential manner to maintain deleterious matter in suspension in the water so that it may be removed by the pool water circulating system.

It is, therefore, one object of this invention to provide a new and improved rotatable pop-up water delivery head for a pool cleaning system.

Another object of this invention is to provide a new and improved rotatable pop-up water delivery head disposed adjacent the inner surface of the pool for washing the interior pool surfaces, the water pressure to which is interrupted periodically to cause the jet dispensing portion of the head to rotate in non-uniform arcuate amounts.

A further object of this invention is to provide a new and improved pop-up rotatable water jet delivery head which delivers a jet stream of recirculated water at an acute angle with the adjacent surface of the pool and at sequentially different arcuate positions with the rotating axis of the head.

A still further object of this invention is to provide a new and improved pop-up rotating jet producing head which rotates under the action of the varying pressure of the water recirculating system of the pool in non-uniform arcuate angles without any gears or other angularly movement controlling mechanisms.

A still further object of this invention is to provide a new and improved pop-up rotating jet producing head which rotates freely when installed in inclined as well as in level surfaces of the pool.

A still further object of this invention is to provide a new and improved pop-up rotating jet producing head which is self-flushing so that debris is effectively prevented from collecting adjacent the head and from being drawn into the head cavity to interfere with its operation.

A still further object of this invention is to provide a novel swimming pool cleaning system employing a plurality of improved rotary jet delivery heads.

A still further object of this invention is to provide an economically producible and efficiently operable novel rotary jet delivery means for a swimming pool recirculating water system which will maintain foreign matter in suspension until it is collected by the swimming pool filtering system.

Further objects and advantages of the invention will become apparent as the description proceeds and the features of novelty which characterize this invention will be pointed out with paticularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
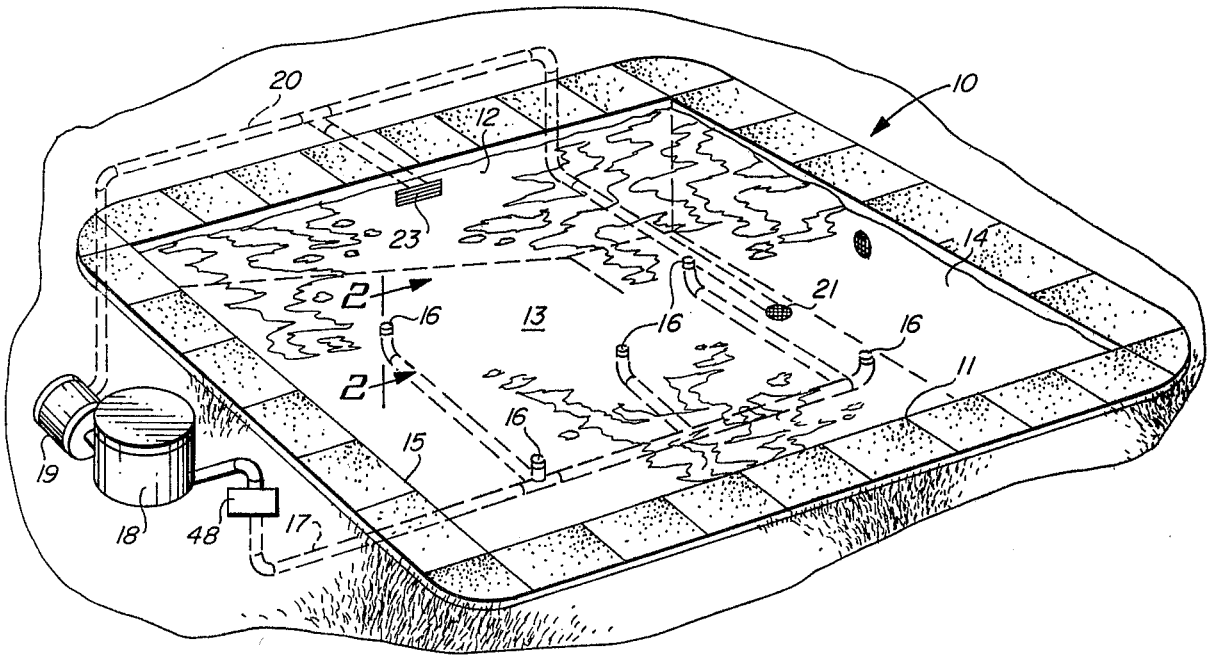
FIG. 1 is a fragmentary perspective view showing a swimming pool with a water circulating and filtering means employing jet dispensing rotary heads embodying the invention.

Referring more particularly to the drawings by characters of reference, FIG. 1 discloses diagrammatically a swimming pool structure 10 having inner side surfaces 11 and 12, a bottom surface 13 and end surfaces 14 and 15. Embedded in the side, bottom and end surfaces 11–15, respectively are a plurality of water jet delivery assemblies 16, hereinafter described in detail.

Communicating with each of the jet delivery assemblies is a conduit 17 adapted to deliver the water under pressure necessary to operate the rotary jet assemblies. This conduit 17 is disposed to communicate with the outlet of a filter 18. An electric motor driven pump assembly 19 delivers water under pressure to the filter and receives water through a conduit 20 communicating with a main drain 21 and with a skimmer 23.

Pump assembly 19 pulls water from main drain 21 and skimmer 23 and forces it through filter 18 and conduit 17 to the rotary jet delivery assemblies 16.

Figure 2:
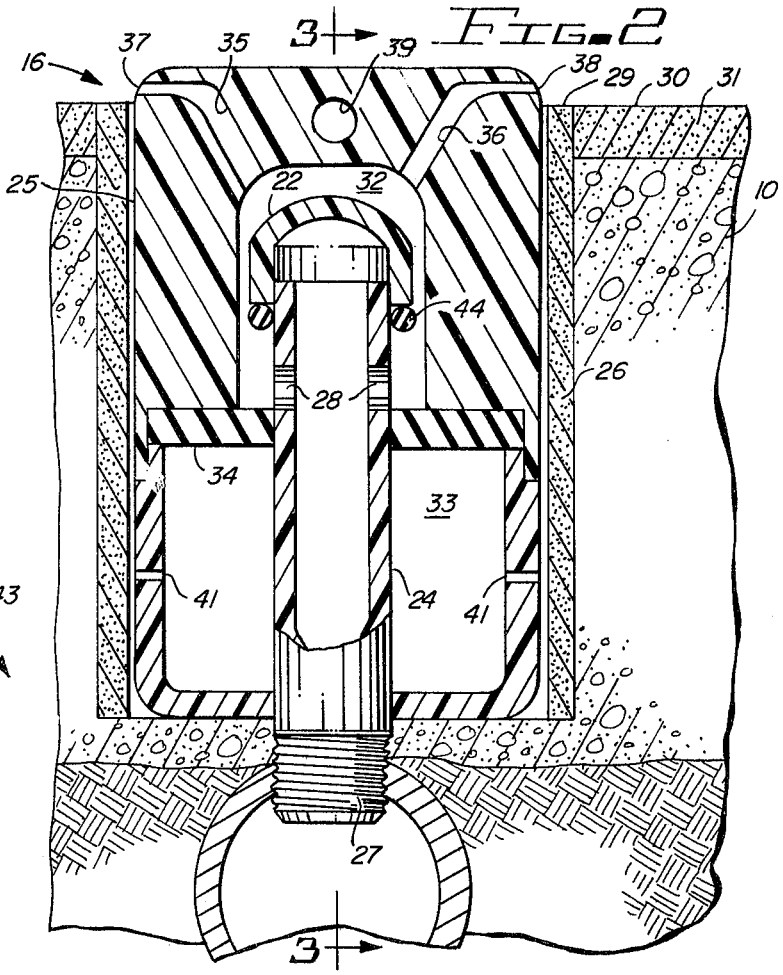
FIG. 2 is a cross-sectional view of FIG. 1 taken along line 2—2.
Figure 4:
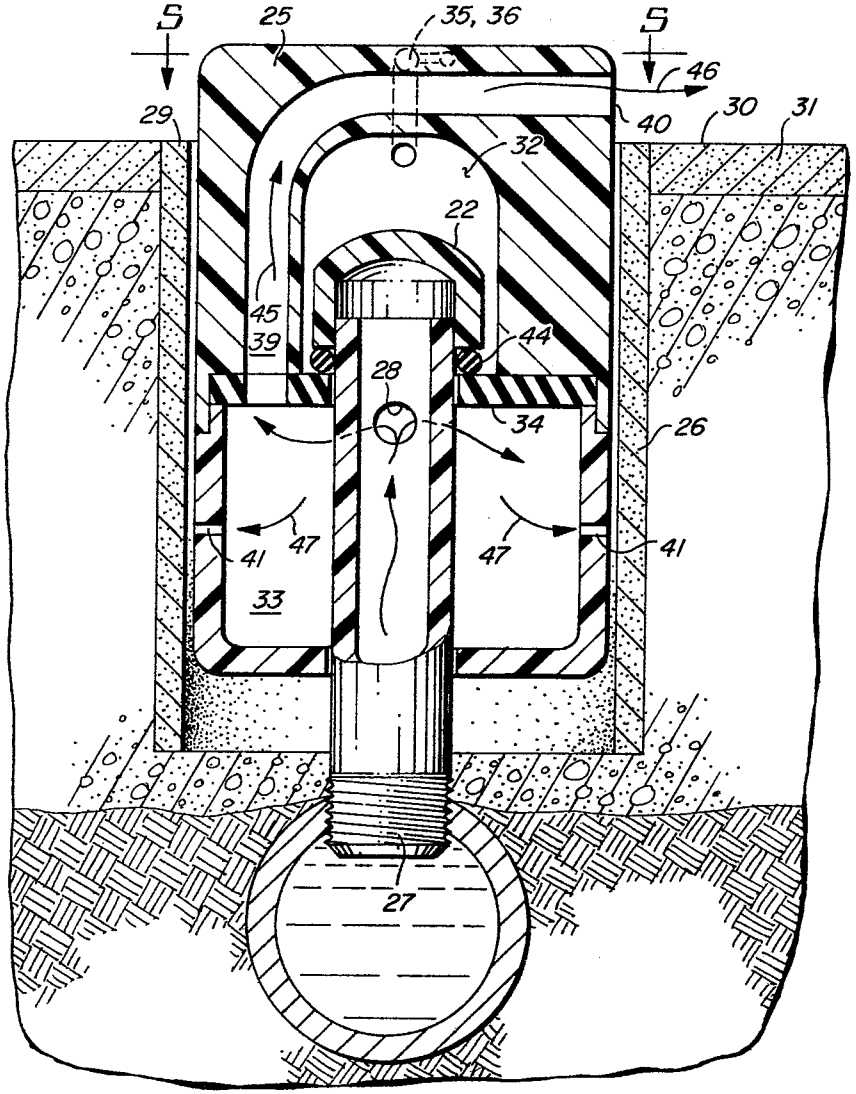
FIG. 4 is a cross-sectional view, again taken along line 3—3 of FIG. 2, but with the pop-up head shown in its extended position.
Figure 3:
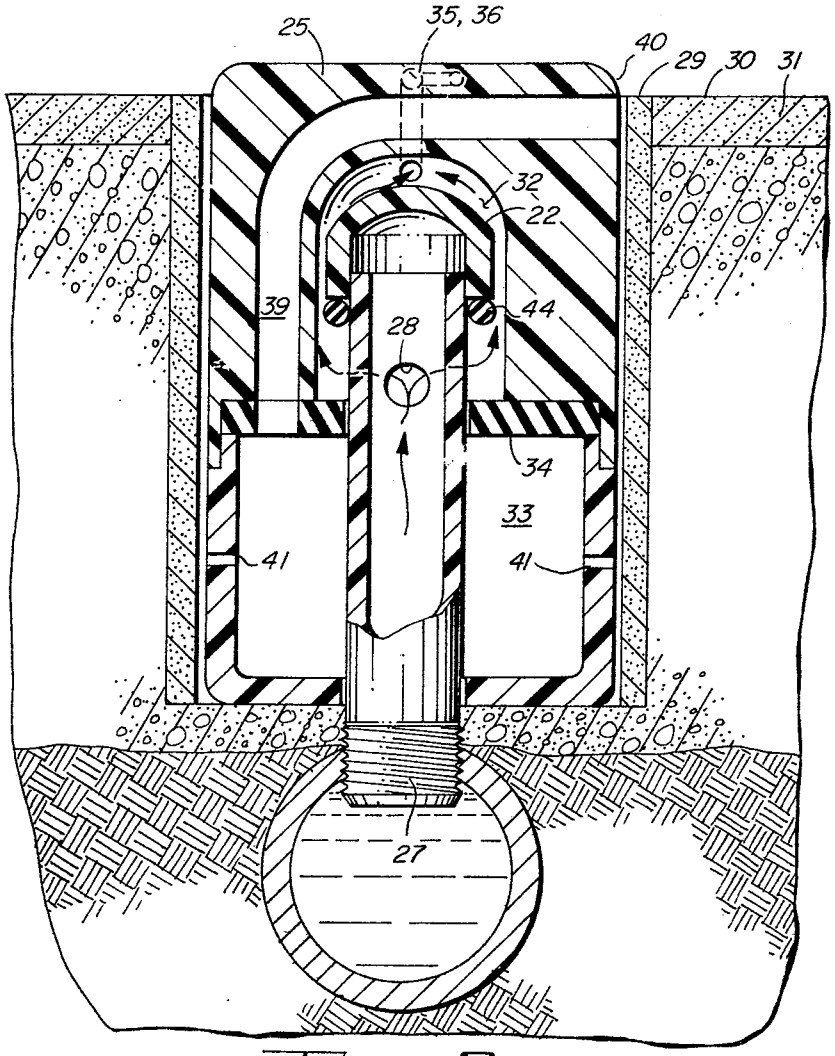
FIG. 3 is a cross-sectional view taken along line 3—3 of FIG. 2 with the pop-up head shown in its retracted position.

As shown in FIGS. 2, 3 and 4, the rotary jet delivery assembly 16 comprises an upright stationary delivery pipe 24 and a pop-up head 25 positioned inside a cavity formed by a cylindrical tube 26.

The lower end 27 of delivery pipe 24 is adapted to be connected to conduit 17 by conventional plumbing fittings not specifically defined in the drawings. The pipe 24 extends approximately two-thirds of the way to the top of the cavity formed by tube 26, and its upper end is closed by a plastic cap 22 of the type that is commercially available for closing the end of a plastic pipe stub. A short distance below its capped upper end, the pipe 24 is provided with two water delivery ports 28 located directly opposite each other on opposite sides of the pipe 24.

The pipe 24 is concentrically centered within the cylindrical cavity formed by tube 26 and it passes through the flat horizontal base of the cavity in making connection to conduit 17. The top surface 29 of tube 26 is flush with the surface 30 of the plaster coating 31 of the pool structure 10. Tube 26 may be of any suitable plastic or metal material commonly employed in plumbing systems.

The pop-up head 25 has an outer cylindrical surface that fits loosely inside the tube 26. Head 25 incorporates an upper cylindrical cavity 32 and a lower cylindrical cavity 33, the two cavities being separated from each other by a diaphragm or horizontal wall means 34, which may be formed of a resilient material such as plastic or rubber. Both of the cavities 32 and 33 concentrically surround the delivery pipe 24, and, depending upon the instant vertical position of the head 25, one or the other of the two cavities may receive water from the interior of pipe 24 via the ports 28.

As shown in FIG. 2, two rotator jet drive ports 35 and 36 extend from the upper end of cavity 32 to their respective points of exit 37 and 38 at opposite sides of the periphery of the upper end of head 25.

The main water delivery port 39, as shown most clearly in FIGS. 3 and 4, extends upward from lower cavity 33, through wall 34, past one side of cavity 32. It then turns ninety degrees and exits the upper end of head 25 horizontally to deliver a cleaning water jet substantially horizontally at point 40.

Lower cavity 33 is also provided with four or more flushing ports 41. The ports 41 pass from the interior of cavity 33 through the adjacent side walls of head 25 into the clearance space between the outer surface of head 25 and the inner surface of tube 26.

Figure 5:
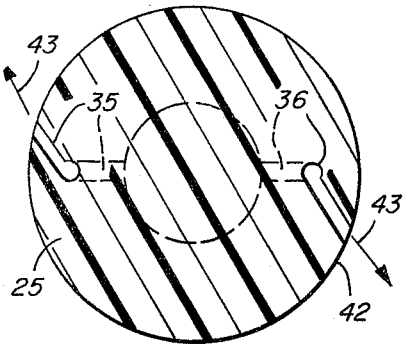
FIG. 5 is a cross-sectional view of FIG. 4 taken along line 5—5.

As shown in FIG. 5, the rotator jet drive ports 35 and 36 exit the periphery 42 of head 25 at an angle approaching a tangential. In the view of FIG. 5 the reactionary forces of the released water jets 43 tend to rotate the head 25 in a counterclockwise direction.

A complete cycle of operation of the jet delivery assembly 16 occurs as follows.

With no water pressure applied via the conduit 17, the head 25 rests on the bottom of the cavity formed by tube 26, as shown in FIGS. 2 and 3. In this position of the head 25, the water delivery ports 28 are located above the horizontal wall 34 and are in communication with upper cavity 32. No water flows at this time through any of the ports 28, 35, 36, 39 or 41.

When water pressure is first applied via conduit 17, water enters upper cavity 32 via the ports 28. From cavity 32 the water passes through ports 35 and 36 to be released as tangential jets 43, the jets 43 initiating the rotation of head 25. At the same time, the water pressure inside cavity 32 exerts an upward force on head 25 which causes head 25 to begin moving upward. Head 25 thus moves upward as it rotates in a spiraling manner.

As the head 25 moves upward in this manner, the wall 34 moves over the ports 28 until it reaches a point above them, whereupon the ports 28 open into lower cavity 33 and are no longer in communication with upper cavity 32. The upper travel of head 25 comes to an end as the upper surface of wall 34 comes to rest against a neoprene O-ring 44 which surrounds pipe 24 just below the lower end of cap 22. The head 25 has now assumed the position shown in FIG. 4. The O-ring 44 seals the opening between pipe 24 and wall 34, effectively preventing any flow of water from lower cavity 33 into upper cavity 32. Any further flow of water to rotator jet drive ports 35 and 36 at this time is thus terminated, as is the rotational movement of head 25. Most of the water now entering lower cavity 33 flows upward through port 39; the remainder flows out through ports 41. The water 45 flowing through port 39 is exhausted in the form of a cleaning jet 46 which exits substantially horizontally or at an acute angle relative to the adjacent pool surface 30. The action of the cleaning jet washes the pool surface and stirs up any debris that has collected thereon so that the debris will become suspended in the pool and eventually circulated for collection and removal by the pool filter. The water flow 47 that exits cavity 33 through the ports 41 passes upward through the clearance space between head 25 and tube 26 in a flushing action that removes any dirt or debris that may have entered. As the flushing water exits the upper end of this clearance space at the surface 30, it clears away any debris that may have settled in the vicinity. Water flow through the main delivery port 39 and through the flushing ports 41 continues until water pressure in conduit 17 is interrupted.

When pressure is interrupted in conduit 17, the gravitational force on head 25 causes head 25 to move downward until it returns to its rest position at the bottom of the cavity formed by tube 26, as shown in FIGS. 2 and 3.

As in the case of the prior art device of U.S. Pat. No. 4,188,673, a pressure interruptor 48 may be installed in series with the water supply conduit 17, as shown in FIG. 1. The interruptor first blocks, then enables, then blocks, then enables again, etc., the flow of water in a continuing periodic manner. Each time flow is initiated, the connected heads 25 rise and turn to a new position before delivering a jet of cleaning water. As pressure is interrupted, the jet of cleaning water terminates and the heads retract. In this fashion the repeatedly redirected cleaning jets clean the entire surrounding pool surface. If a sufficient number of jet assemblies 16 are distributed over the pool surface, the entire pool may be cleared in this manner.

Improved performance in terms of head rotation is achieved, first of all, because of the incorporation of the dual jet arrangement. Because ports 35 and 36 exit at opposite sides of the head 25, radial forces produced by the two jets 43 balance each other out while their tangential components are additive. Furthermore, the flushing action introduced by the water flow through ports 41 keeps the adjoining surfaces of head 25 and tube 26 free of any sand, grit or other debris that could otherwise frictionally interfere with rotation. As mentioned earlier, the flushing action also aids in cleaning the nearby surfaces surrounding the assembly 16.

It will be recognized that various materials such as plastics and metals of many types may be found suitable for the construction of the individual parts of the assembly 16. In many cases, standard plastic pipe lengths and fittings that are commercially available will be found suitable and will permit the realization of an exceptionally low manufacturing cost. Any such variations in materials and/or assembly techniques are considered to fall within the scope of the present invention.

Although but a single embodiment of the present invention has been illustrated and described, it will be apparent to those skilled in the art that various changes and modifications may be made therein without departing from the spirit of the invention or from the scope of the appended claims.

What is claimed is:

1. A rotatable pop-up water delivery head for positioning in an opening in the surface of a swimming pool and for connection to a swimming pool cleaning system comprising:

a conduit for positioning in said opening and connectable at one end to said cleaning system and closed at its other end, a hollow, cylindrical, closed ended housing slidably mounted around said conduit for a limited movement therealong, wall means formed in said housing at a point between its ends around said conduit and defining two cavities in said housing, one on each side of said wall means, with said other end of said conduit being positioned in one of said cavities, an outlet port in said conduit at a point within said housing, said outlet port upon slidable movement of said housing being positioned in said one of said cavities when water under pressure is absent in said conduit and positioned in the other of said cavities when water under pressure exists in said conduit, a first conduit means formed in one end of said housing interconnecting at one end with the other of said cavities to form an inlet port and terminating at its other end in an outlet port for projecting a pressurized stream of water from said other of said cavities laterally to the axis of said housing in a direction substantially parallel and in a scrubbing relation to the surface of an associated pool when said housing is moved, positioning said outlet port in said other of said cavities, a second conduit means formed in said one end of said housing and extending from said one of said cavities through said one end of said housing and diametrically out of the sides of said one end tangentially thereof for rotating said housing when said outlet port is in said one of said cavities, whereby when water under pressure is forced through said conduit, it will flow through said outlet port into said one of said cavities and out of said second conduit means to rotate said housing and axially move said housing along said conduit to position said outlet port in said other of said cavities, the movement of said housing along said conduit causing said wall means to open said outlet port into said other of said cavities causing water under pressure to move through said first conduit means and to exit in a scrubbing manner from said first conduit means across the adjacent surface of said pool.

2. The rotatable pop-up water delivery head set forth in claim 1 wherein:

said one end of said housing is weighted to cause said housing to position under the action of gravity said outlet port in said one of said cavities when water under pressure is absent in said conduit.

3. The rotatable pop-up water delivery head set forth in claim 1 in further combination with:

means mounted on said conduit adjacent said other end thereof for sealing said one of said cavities closed when said outlet port is in said other of said cavities.

4. The rotatable pop-up water delivery head set forth in claim 3 wherein:

said means comprises an O-ring sealing an opening in said wall means through which said conduit extends.

5. The rotatable pop-up delivery head set forth in claim 1 in further combination with:

outlet port means provided in the other end of said housing for causing water to flow out of said housing when said outlet port is in said other of said cavities to flush debris out of the associated opening in the swimming pool.

6. The rotatable pop-up water delivery head set forth in claim 1 wherein:

said housing comprises two interconnectable parts arranged to mount said wall means therebetween.

7. The rotatable pop-up water delivery head set forth in claim 1 wherein:

said wall means comprises a diaphragm.

8. The rotatable pop-up water delivery head set forth in claim 1 wherein:

said wall means is formed of a resilient material.

9. The rotatable pop-up water delivery head set forth in claim 4 wherein:

said conduit and housing are formed of a suitable plastic, said conduit is closed at its other end by a cap fitting around the outside periphery of said other end, and said O-ring is secured to the periphery of the opening of said cap.

* * * * *